US007303486B2

(12) United States Patent
Imamoto

(10) Patent No.: US 7,303,486 B2
(45) Date of Patent: Dec. 4, 2007

(54) GOLF CLUB HEAD

(75) Inventor: Yasunori Imamoto, Tokyo (JP)

(73) Assignee: Bridgestone Sports Co. Ltd, Tokyo (JP)

( * ) Notice: Subject to any disclaimer, the term of this patent is extended or adjusted under 35 U.S.C. 154(b) by 212 days.

(21) Appl. No.: 11/048,045

(22) Filed: Feb. 2, 2005

(65) Prior Publication Data

US 2005/0192116 A1 Sep. 1, 2005

(30) Foreign Application Priority Data

Feb. 3, 2004 (JP) ..... P2004-026938

(51) Int. Cl.
*A63B 53/04* (2006.01)

(52) U.S. Cl. ..... 473/332; 473/345; 473/350

(58) Field of Classification Search ..... 473/324–350
See application file for complete search history.

(56) References Cited

U.S. PATENT DOCUMENTS

| | | | | |
|---|---|---|---|---|
| 2,846,228 | A | 8/1958 | Reach | |
| 4,928,972 | A | 5/1990 | Nakanishi et al. | |
| 5,316,298 | A | 5/1994 | Hutin et al. | |
| 5,766,092 | A | 6/1998 | Mimeur et al. | |
| 6,045,456 | A * | 4/2000 | Best et al. | 473/291 |
| 6,616,547 | B2 * | 9/2003 | Vincent et al. | 473/334 |
| 6,695,714 | B1 * | 2/2004 | Bliss et al. | 473/328 |
| 6,835,144 | B2 * | 12/2004 | Best | 473/332 |
| 6,991,559 | B2 * | 1/2006 | Yabu | 473/332 |
| 2002/0022535 | A1 | 2/2002 | Takeda | |
| 2004/0043830 | A1 * | 3/2004 | Imamoto | 473/332 |
| 2005/0096151 | A1 * | 5/2005 | Hou et al. | 473/335 |

FOREIGN PATENT DOCUMENTS

| | | |
|---|---|---|
| JP | 53-65128 | 6/1978 |
| JP | 5-293201 A | 11/1993 |
| JP | 7-213656 A | 8/1995 |
| JP | 9-24125 A | 1/1997 |
| JP | 9-117537 A | 5/1997 |
| JP | 9-215795 A | 8/1997 |
| JP | 9-276455 A | 10/1997 |
| JP | 2000-176056 A | 6/2000 |
| JP | 2003-33453 A | 2/2003 |

* cited by examiner

*Primary Examiner*—Eugene Kim
*Assistant Examiner*—Alvin A Hunter
(74) *Attorney, Agent, or Firm*—Sughrue Mion, PLLC

(57) ABSTRACT

A golf club head made of metal includes a face surface, a back surface, and an elastic body. Plural hollow portions are defined between the face surface and the back surface and are arranged in an upper and lower direction. The elastic body is filled in the lowermost hollow portion. The plural hollow portions are defined in a lower portion of the golf club head.

19 Claims, 3 Drawing Sheets

GOLF CLUB HEAD

BACKGROUND OF THE INVENTION

1. Field of the Invention

The present invention relates to a golf club head, and more particularly to a golf club head having a hollow portion and an elastic body filled in the hollow portion.

2. Description of the Related Art

JP-A-Hei.9-24125 describes a golf club head in which rubber, a rubber-like elastic body or a spring is provided in a hollow portion defined between a face surface and a back surface of a golf club head. JP-A-Hei.9-24125 also describes that the rubber is filled in a slightly compressed state. In addition, JP-A-Hei.9-24125 describes that the golf club head is made up of a head main body and a face plate mounted on a front surface of the head main body.

JP-A-Hei.9-215795 describes that a fibrous shock absorbing material is disposed within a hollow portion.

JP-A-Sho.53-65128 describes that an epoxy resin is injected into an empty space constituting a hollow portion and is then cured therein.

JP-A-Hei.5-293201 describes that a synthetic resin having stickiness is coated on the interior of a recess portion provided in a face surface, following this, a face plate is disposed in the recess portion, and thereafter, the synthetic resin is cured thermally.

The U.S. Pat. No. 5,766,092 describes that a foamable resin liquid is injected into a hollow portion and is then made to foam therein so as to fill the hollow portion with a foamed plastic.

SUMMARY OF THE INVENTION

In the conventional golf club heads, the center of gravity is high. An object of the invention is to lower the center of gravity of a golf head club in which an elastic body is disposed in a hollow portion therein.

According to a first aspect of the invention, a golf club head made of metal includes a face surface, a back surface, and a elastic body. Plural hollow portions are defined between the face surface and the back surface and are arranged in an upper and lower direction. The elastic body is filled in the lowermost hollow portion. The plural hollow portions are defined in a lower portion of the golf club head.

According to a second aspect of the invention, the golf club head of the first aspect is one of an iron type golf club head and a utility type golf club head.

According to a third aspect of the invention, in the golf club head of the first or second aspect, the elastic body is filled in the lowermost hollow portion in a compressed state. The elastic body is in close contact with a surface of the lowermost hollow portion.

According to a fourth aspect of the invention, in the golf club head of any one of the first to third aspects, an empty portion where the elastic body does not exist is defined at a rearmost portion of the lowermost hollow portion.

According to a fifth aspect of the invention, the golf club head of any one of the first to fourth aspects further includes a head main body that has a hosel portion, and a face plate mounted on a front side of the head main body. An upper portion of the head main body defines an opening portion that penetrates the head main body in a forward and rearward direction. A lower portion of the head main body defines plural recess portions that open forward. The plural recess portions are the plural hollow portions.

According to a sixth aspect of the invention, in the golf club head of any one of the first to fifth aspects, the elastic body includes a thermoplastic elastomer.

According to a seventh aspect of the invention, in the golf club head of any one of the first to sixth aspects, the elastic body has JIS C hardness in a range of 15 to 80.

According to an eighth aspect of the invention, in the golf club head of any one of the first to seventh aspects, the elastic body includes particles of one selected from a group consisting of tungsten, tungsten alloy, stainless steel, lead, and copper.

In the golf club head of the first aspect, the plural hollow portions are arranged in an upper and lower direction and are defined in a lower portion of the golf club head. In addition, the elastic body is filled in the lowermost hollow portion. Therefore, the center of gravity of the golf club head is low. In particular, the center of gravity of the golf club head can be lowered sufficiently when the golf club head is configured to have a head main body that comprises a hosel portion and a face plate mounted on a front side of the head main body wherein an upper portion of the head main body defines an opening portion that penetrates the head main body in a forward and rearward direction. In this case, the face plate is preferably fixed to the head main body by caulking a circumferential edge portion of the head main body.

The golf club head of the second aspect is suitable for an iron or utility golf club head. The utility golf club head is a golf club head, which is longer in the forward and rearward direction than a conventional iron golf club head but shorter in the forward and rearward direction than that of a wood golf club.

In the golf club head of the third aspect, the elastic body is filled in the lowermost hollow portion in a compressed state, and the elastic body is in close contact with a surface of the lowermost hollow portion (e.g., a rear surface of the face plate). Therefore, the feeling of striking a golf ball felt through the golf club head is improved.

In particular, in the golf club head of the fourth aspect, an empty portion where the elastic body does not exist is defined at a rearmost portion of the lowermost hollow portion. Therefore, the elastic body can be elastically deformed in such a manner as to enter the interior of the empty space at the time of hitting a golfball, and the face surface can also be elastically deformed. As a result, the impact resilience of the golf ball so hit can be improved.

The elastic body may be arranged in at least a normal ball hitting area.

When the elastic body has JIS C hardness in a range of 15 to 80, the ball-hitting feeling felt at the time of hitting a golf ball can be improved.

The elastic body may include a thermoplastic elastomer.

When the elastic body includes particles of one selected from a group consisting of tungsten, tungsten alloy, stainless steel, lead, and copper., the center of gravity of the golf club head can be lowered.

DETAILED DESCRIPTION OF THE PREFERRED EMBODIMENTS

An embodiment of the invention will be described below with reference to the accompanied drawings.

Figure 1A:
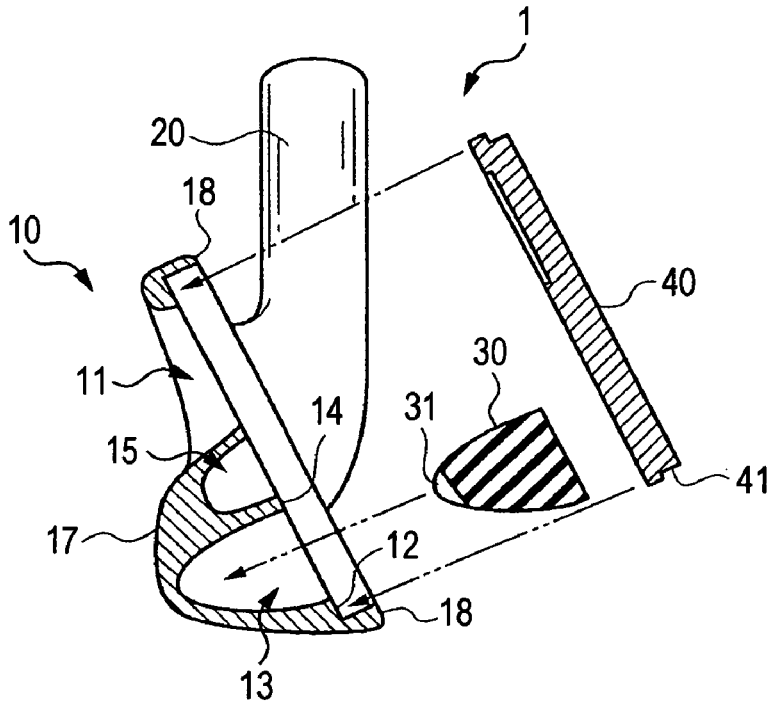
FIGS. 1A and 1B are an exploded cross-sectional view and a vertical cross-sectional view taken along a widthwise center of a face of a golf club head according to an embodiment of the invention.
Figure 1B:
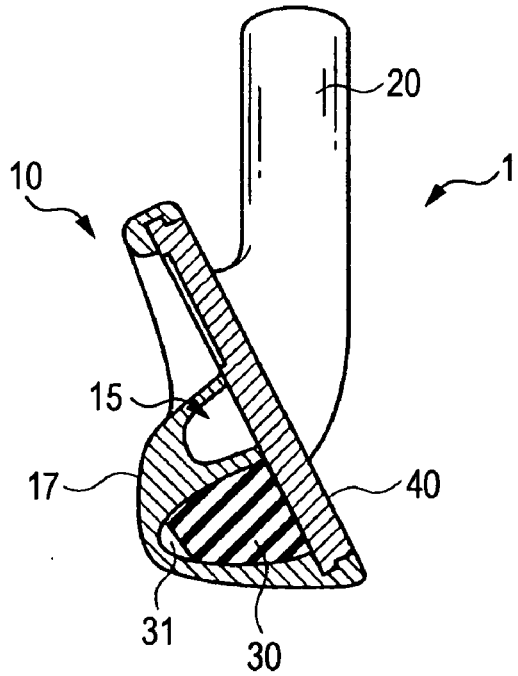
Figure 2:
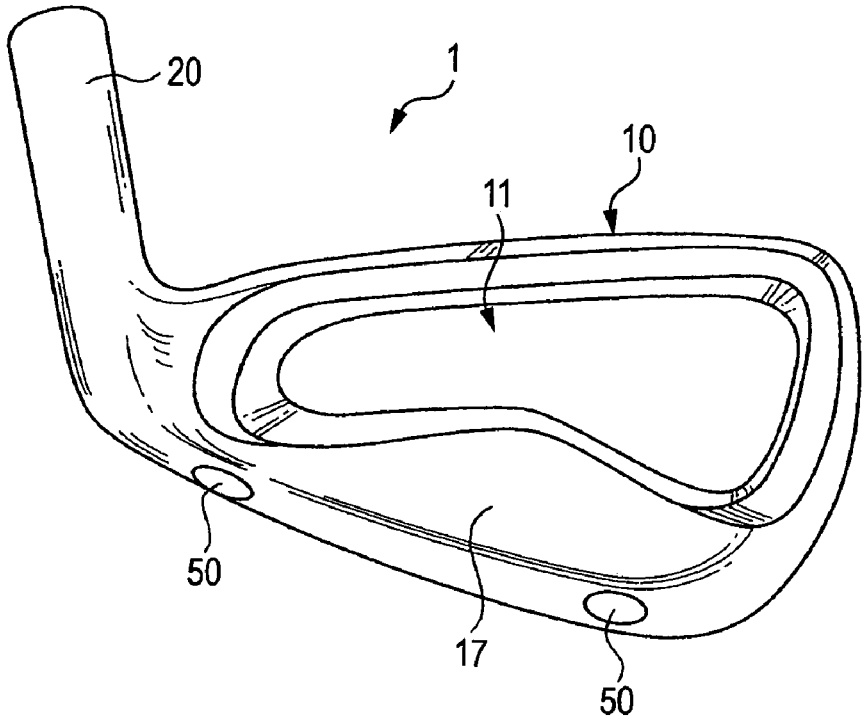
FIG. 2 is a perspective view of a back of a head main body as seen slightly therebelow.
Figure 3:
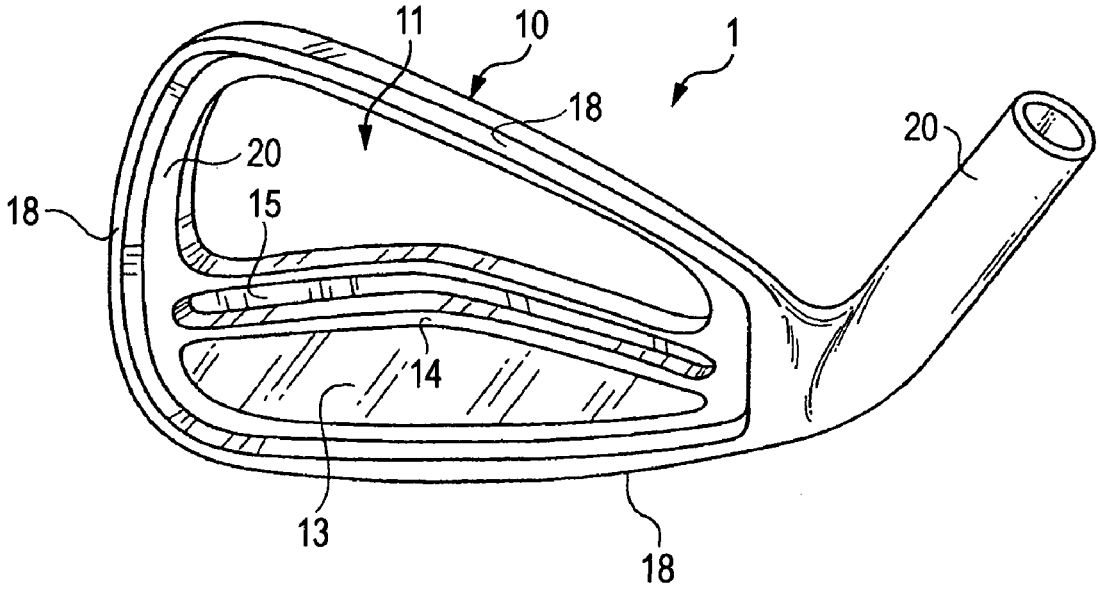
FIG. 3 is a perspective view of a front of the head main body as seen slightly thereabove.
Figure 4A:
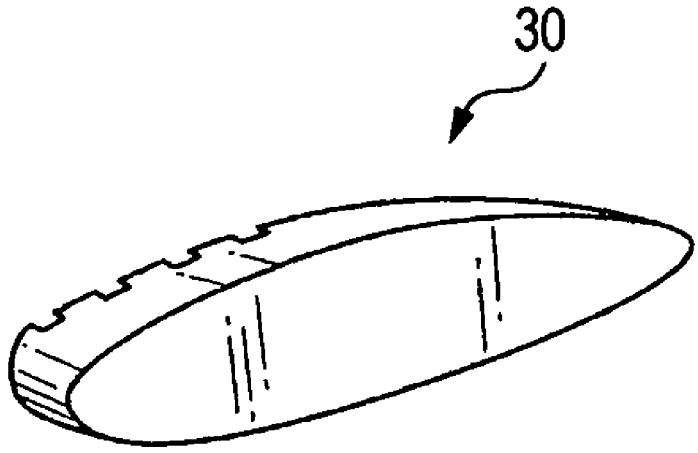
FIG. 4A is a perspective view of an elastic body 30 as seen from the front thereof.
Figure 4B:
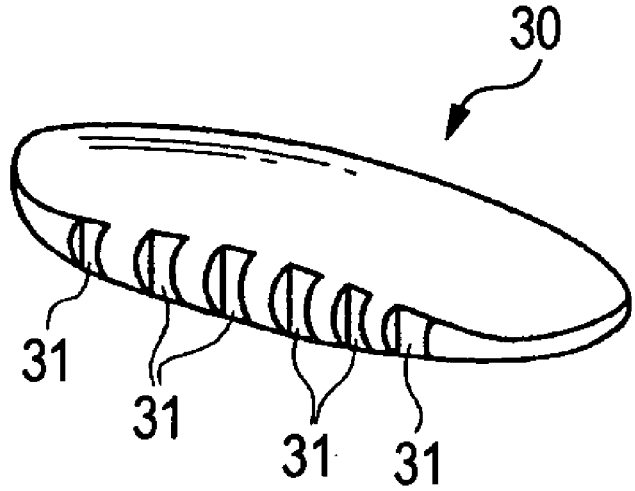
FIG. 4B is a perspective view of the elastic body 30 as seen from the rear thereof.

FIGS. 1A and 1B are, respectively, an exploded cross-sectional view and a vertical cross-sectional view taken along a widthwise center of a face of a golf club head according to an embodiment of the invention. FIG. 2 is a perspective view of a back of a head main body as seen slightly therebelow. FIG. 3 is a perspective view of a front of the head main body as seen slightly thereabove. FIGS. 4A and 4B are, respectively, perspective views of an elastic body.

A golf club head 1 according to this embodiment has a head main body 10, a face plate 40 secured to a front side of the head main body 10, weights 50 secured to a bottom side of a sole portion of the head main body 10, and an elastic body 30 filled in a hollow portion within the golf club head 1.

Opening 11, which penetrates the head main body 10 from front to back, is defined in an upper portion of the head main body 10. A stepped portion 12 is formed in a circumferential edge portion on the front side of the head main body 10 in such a manner that the face plate 40 fits therein.

A first recess portion 13 and a second recess portion 15, which open forward, are defined in a lower portion of the head main body 10. The second recess portion 15 is positioned above the first recess portion 13. A partition wall 14 is provided between the recess portions 13, 15 in such a manner as to be flush with the stepped portion 12.

These recess portions 13, 15 extend from the vicinity of a toe of the head main body 10 to the vicinity of a heel of the head main body 10. The second recess portion 15 bends into an inverted V-like shape such that an intermediate portion in a toe-heel direction becomes highest.

The first recess portion 13 is formed such that a vertical width thereof becomes maximum at an intermediate portion in the toe-heel direction and is gradually reduced therefrom towards the toe side and the heel side, respectively.

The lower portion of the head main body 10 where the first and second recess portions 13, 15 are defined constitutes an expanded portion 17, which is expanded rearward of the head main body 10. This expanded portion 17 is provided over almost the whole width of the head main body 10 from the toe side to the heel side.

The first recess portion 13 and the second recess portion 15 preferably have a width in the toe-heel direction, which is equal to 70% to 90% of the width of the face plate 40.

It is preferable that the vertical width of the first recess portion 13 at the intermediate portion thereof (representing a maximum width in a direction parallel to the face surface) is in a range of 7 mm to 20 mm and, in particular, in a range of 10 mm to 18 mm. A vertical width of the second recess portion 15 is substantially uniform over the whole length stretching in the toe-heel direction and preferably is in a range of 4 mm to 10 mm and, in particular, in a range of 5 mm to 8 mm. As is seen from the above, widest portions of the recess portions 13, 15 are positioned in the vicinity of the center of the face (namely, a longitudinal center of the corrugations provided in the face surface).

It is preferable that the volume of the first recess portion preferably is in a range of 4 $mm^3$ to 10 $mm^3$, in particular, in a range of 5 $mm^3$ to 8 $mm^3$. It is preferable that the volume of the first recess portion 13 is in a range of 1 $mm^3$ to 4 $mm^3$, in particular, in a range of 1.5 $mm^3$to 3.0 $mm^3$. Also, it is preferable that the volume of the first recess portion is twice to ten times larger than that of the second recess portion 15, in particular, three times to five times larger.

A rib 18 is provided in such a manner as to extend circumferentially around an edge portion of the stepped portion 12. At a time of caulking and fixing the face plate 40, this rib 18 is deformed. A recess-like stepped portion 41 is provided circumferentially around a circumferential portion of a front edge of the face plate 40. The rib 18 is brought into engagement with the stepped portion 41 when the rib 18 is caulked. The thickness of the face plate 40 preferably is in a range of 1 mm to 4 mm, in particular, in a range of 1.5 mm to 3.5 mm. When the thickness is in this range, the ball-hitting feeling can be improved, and the resilient characteristic can also be improved by making use of the deformation of the face plate.

Note that the face plate 40 may be secured to the head main body 10 by welding instead of caulking.

A hosel portion 20 is provided on the heel side of the head main body 10. A recess portion is defined in the bottom side (the sole side)of the head main body 10 on the heel side and the toe side thereof, respectively. The weights 50 made of a high-gravity metal such as a tungsten alloy are fixedly fitted or secured in the recess portions so provided by welding.

While the elastic body 30 is fitted to the first recess portion 13, the elastic body 30 is formed slightly bigger than the first recess portion 13 in the forward and rearward direction. Concave grooves 31 are defined in a rear side of the elastic body 30. In this embodiment, the recess grooves 31 are defined as recess stripes, which extend vertically across the rear side of the elastic body 30. While six concave grooves 31 are defined in this embodiment, 1 to 10 concave grooves may be accepted.

When assembling the golf club head 1, the elastic body 30, which is slightly bigger in size than the first recess portion 13, is fitted in the first recess portion 13. When so fitted, a front side of the elastic body 30 protrudes slightly (preferably, by 0.1 mm to 0.5 mm) from the stepped portion 12. Next, the face plate 40 is brought into engagement with the stepped portion 12, and the rib 18 is caulked so that the face plate 40 is secured to the head main body 10. The elastic body 30 is filled within the recess portion 13 in a compressed state by being pressed by the face plate 40. Then, the entirety of the front side of the elastic body 30 is caused to adhere to a rear side of the face plate 40.

Note that the recess grooves 31 remain even when the elastic body 30 is compressed, and a space portion (an empty space) derived from the recess grooves 31 is produced at a rear portion of the recess portion 13.

It is preferable that a material of the elastic body 30 is elastomer such as styrene elastomer, olefin elastomer, urethane elastomer, ester elastomer, amide elastomer, 1,2-polybutadiene, ionomer resin and transpolyisoprene. In particular, urethane elastomer, amide elastomer and 1,2-polybutadiene are preferred.

In a case where a thermoplastic elastomer is used as the elastomer, the softening temperature thereof is preferably 80° C. or higher. This is because the plastic deformation of elastomer is prevented even when a golf club is accommodated in the boot of an automobile parked under the sunlight in summer.

In the event that the hardness of the elastic body 30 is in a range of JIS C 15 to JIS C 80, in particular, JIS C 18 to JIS C 70, and above all, JIS C 20 to JIS C 60, the ball-hitting feeling of the golf club head 1 becomes good.

Metallic powder of high-gravity metals such as tungsten, tungsten alloy, stainless steel, lead, and copper may be incorporated in the elastic body 30, so that the gravity thereof can be increased (for example, a specific gravity in a range of 5.0 to 10.0).

Material of the face plate 40 includes, for example, stainless steel, maraging steel, copper alloy such as brass, beryllium copper and bronze, titan, titan alloy, a high-strength aluminum alloy such as duralumin, amorphous metals and FRM.

With a golf club head in which the head main body is made of stainless steel or mild iron (whose specific gravity is 7.8), and the face member is made of titan alloy (whose specific gravity is in a range of 4.2 to 5.0) or duralumin (whose specific gravity is 2.8), the depth of center of gravity becomes deep. In the event that the face plate is made of copper alloy, the amount of back spin of a ball is increased when the ball is hit by the golf club 1. Since a face plate made of Zr amorphous alloy provides a low Young's modulus in a range of 85 GPa to 100 GPa, the coefficient of restitution of a golf club head using such a faceplate is increased to there by increase, in turn, the initial speed of a ball hit thereby.

While a golf club head having a face plate of a low Young's modulus tends to bend largely when a ball is shot thereby, the elastic body 30 disposed behind the face plate prevents the large bending of the face plate to thereby suppress the vibration of the face plate.

The material of the head main body may be the same as or different from the material of the face plate.

In the golf club head 1 configured as has been described heretofore, since the expanded portion 17 having the hollow portions (the first recess portion 13 and the second recess portion 15) is disposed only on the lower side of the back surface of the golf club head 1, the center of gravity of the golf club head 1 is lowered. In particular, since the opening 11 is defined in the upper portion of the head main body 10, the weight of the upper side of the head main body 10 is reduced, and the center of gravity of the golf club head 1 is lowered.

In addition, in the golf club head 1, the elastic body 30 is filled in the interior of the first recess portion 13 in the compressed state, so that the entirety of the front side of the elastic body 30 is caused to adhere to the rear side of the face plate 40. Therefore, vibrations produced when a ball is hit can be absorbed by the elastic body 30 to thereby improve the ball-hitting feeling.

In this embodiment, since the second recess portion 15 constitutes an empty space where the elastic body 30 does not exist, the center of gravity of the golf club head 1 is lowered.

What is claimed is:

1. A golf club head made of metal comprising:

a face surface;

a back surface, plural hollow portions being defined between the face surface and the back surface, the plural hollow portions including a first hollow portion and a lowermost hollow portion, and the first hollow portion being arranged above the lowermost hollow portion;

an elastic body filled in the lowermost hollow portion, wherein:

the plural hollow portions are defined in a lower portion of the golf club head.

2. The golf club head according to claim 1, wherein the golf club head is one of an iron type golf club head and a utility type golf club head.

3. The golf club head according to claim 1, wherein:

the elastic body is filled in the lowermost hollow portion in a compressed state; and the elastic body is in close contact with a surface of the lowermost hollow portion.

4. The golf club head according to claim 1, wherein an empty portion where the elastic body does not exist is defined at a rearmost portion of the lowermost hollow portion.

5. The golf club head according to claim 1, wherein an empty portion is defined between the elastic member and an internal rearmost portion of the lowermost hollow portion.

6. The golf club head according to claim 1, further comprising:

a head main body that comprises a hosel portion; and a face plate mounted on a front side of the head main body, wherein;

an upper portion of the head main body defines an opening portion that penetrates the head main body in a forward and rearward direction;

a lower portion of the head main body defines plural recess portions that open forward; and the plural recess portions are the plural hollow portions.

7. The golf club head according to claim 1, wherein the elastic body includes a thermoplastic elastomer.

8. The golf club head according to claim 1, wherein the elastic body has JIS C hardness in a range of 15 to 80.

9. The golf club head according to claim 1, wherein the elastic body includes particles of one selected from a group consisting of tungsten, tungsten alloy, stainless steel, lead, and copper.

10. A golf club head comprising:

a head main body that defines an opening penetrating the head main body and plural recess portions, the plural recess portions including a first recess portion and a lowermost recess portion, the first recess portion being arranged above the lowermost recess portion, and the opening being located higher than the recess portions;

an elastic member that is disposed in the lowermost recess portion; and a face plate that is mounted on the head main body.

11. The golf club head according to claim 10, wherein:

the elastic body is disposed in the lowermost recess portion in a compressed state; and the elastic body is in close contact with a surface of the lowermost recess portion and a surface of the face plate.

12. The golf club head according to claim 10, wherein the elastic member defines at least one groove therein.

13. The golf club head according to claim 12, wherein the at least one groove of the elastic member forms an empty portion in the lowermost recess portion of the golf club head.

14. The golf club head according to claim 10, wherein the recess portion other than the lowermost recess portion forms an empty portion.

15. The golf club head according to claim 10, further comprising at least one weight that is located lower than the opening.

16. The golf club head according to claim 10, wherein the elastic body includes a thermoplastic elastomer.

17. The golf club head according to claim 10, wherein the elastic body has JIS C hardness in a range of 15 to 80.

18. The golf club head according to claim 10, wherein the elastic body includes particles of one selected from a group consisting of tungsten, tungsten alloy, stainless steel, lead, and copper.

19. A golf club head comprising:

a head main body that defines an opening penetrating main body and plural recess portions, the opening being located higher than the recess portions;

a elastic member that is disposed in the lowermost recess portion; and a face plate that is mounted on the head main body;

wherein the elastic member defines at least one groove therein, wherein the at least one groove of the elastic member forms an empty portion in the lowermost recess portion of the golf club head.

* * * * *